United States Patent [19]

Stuntz et al.

[11] Patent Number: 4,504,380

[45] Date of Patent: Mar. 12, 1985

[54] PASSIVATION OF METAL CONTAMINANTS IN CAT CRACKING

[75] Inventors: Gordon F. Stuntz, Baton Rouge, La.; Terry A. Reid, Florham Park, N.J.

[73] Assignee: Exxon Research and Engineering Co., Florham Park, N.J.

[21] Appl. No.: 525,826

[22] Filed: Aug. 23, 1983

[51] Int. Cl.[3] ..... C10G 11/00

[52] U.S. Cl. ..... 208/113; 208/120; 502/34; 502/521

[58] Field of Search ..... 502/34, 521; 208/113, 208/120

[56] References Cited

U.S. PATENT DOCUMENTS

| | | | |
|---|---|---|---|
| 3,254,020 | 5/1966 | Frayer | 208/89 |
| 3,412,013 | 11/1968 | Bowles | 208/120 |
| 3,413,212 | 11/1968 | Weisz | 208/120 |
| 3,479,279 | 11/1969 | Pohlenz | 208/56 |
| 3,533,936 | 10/1970 | Weisz | 208/56 |
| 3,943,053 | 3/1976 | Kovach et al. | 585/258 |
| 4,035,285 | 7/1977 | Owen et al. | 208/120 |
| 4,064,036 | 12/1977 | Clark | 208/46 |
| 4,083,807 | 4/1978 | McKinney | 208/120 |
| 4,115,467 | 9/1978 | Fowler | 585/324 |
| 4,183,803 | 1/1980 | McKay | 208/120 |
| 4,216,120 | 8/1980 | Nielsen | 502/162 |
| 4,268,416 | 5/1981 | Stine et al. | 252/416 |
| 4,280,895 | 7/1981 | Stuntz et al. | 208/113 |
| 4,280,896 | 7/1981 | Bearden et al. | 208/113 |
| 4,280,898 | 7/1981 | Tatterson et al. | 208/119 |
| 4,298,459 | 11/1981 | Tatterson et al. | 208/120 |
| 4,361,496 | 11/1982 | Castillo et al. | 252/416 |
| 4,364,848 | 12/1982 | Castillo et al. | 252/417 |
| 4,370,220 | 1/1983 | Bearden et al. | 208/108 |
| 4,372,840 | 2/1983 | Bearden et al. | 208/113 |
| 4,372,841 | 2/1983 | Stuntz et al. | 208/113 |
| 4,382,015 | 5/1983 | Castillo et al. | 252/417 |
| 4,404,090 | 9/1983 | Castillo et al. | 208/120 |
| 4,409,093 | 10/1983 | Bearden, Jr. et al. | 285/737 |

FOREIGN PATENT DOCUMENTS

| | | | |
|---|---|---|---|
| 52356 | 5/1982 | European Pat. Off. . | |
| 1414915 | 9/1964 | France | 585/312 |
| WO82/04063 | 11/1982 | PCT Int'l Appl. . | |
| 1570682 | 7/1980 | United Kingdom . | |

OTHER PUBLICATIONS

"Copper(I)-Ethylene Complexes in Y Zeolite" by Yu-n-Yang Huang et al., J.C.S. Chem. Comm., 1974, pp. 584–585.

*Primary Examiner*—Delbert E. Gantz
*Assistant Examiner*—Cynthia A. Prezlock
*Attorney, Agent, or Firm*—Edward H. Mazer; Robert J. North

[57] ABSTRACT

A method for passivating metal contaminants present in a hydrocarbon feedstock which become deposited on cracking catalyst is described. The method is directed at passing the cracking catalyst through a passivation zone having a reducing atmosphere maintained at an elevated temperature by the introduction of a process reducing gas. The unsaturated hydrocarbon content of the reducing gas is decreased prior to the introduction of the process reducing gas into the passivation zone to thereby lower the rate of coke formation. In a preferred embodiment process reducing gas is passed through a hydrogenation zone adapted to hydrogenate an unsaturated hydrocarbon present in the process reducing gas prior to the process reducing gas being added to the passivation zone.

23 Claims, 1 Drawing Figure

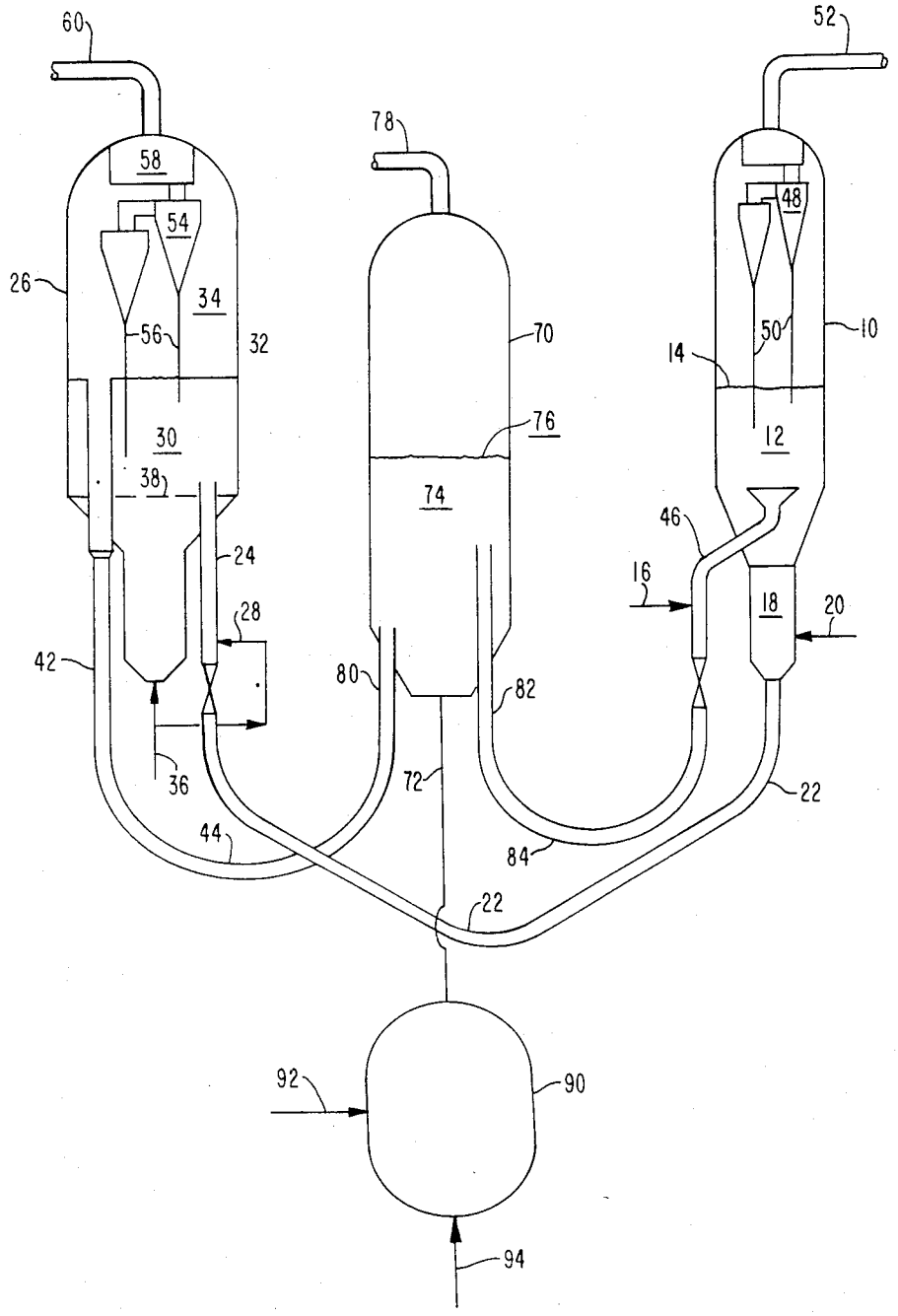
60
52
78
58
54
48
26
34
56
32
70
50
10
14
76
30
12
38
74
46
24
16
28
18
20
42
80
82
36
72
22
44
84
22
92
90
94

PASSIVATION OF METAL CONTAMINANTS IN CAT CRACKING

BACKGROUND OF THE INVENTION

This invention is directed at a method for saturating unsaturated hydrocarbon compounds, from a process reducing gas stream utilized for metals passivation. More specifically, the present invention is directed at a method for hydrogenating olefins present in a refinery process reducing gas stream utilized for passivating metals contaminated cracking catalyst.

In the catalytic cracking of hydrocarbon feedstocks, particularly heavy feedstocks, nickel, vanadium and/or iron present in the feedstocks become deposited on the cracking catalyst promoting excessive hydrogen and coke makes. These metal contaminants are not removed by conventional catalyst regeneration operations, which convert coke deposits on the catalyst to CO and $CO_2$.

As used hereinafter, the term "passivation" is defined as a method for decreasing the detrimental catalytic effects of metal contaminants such as nickel, vanadium and/or iron which become deposited on the cracking catalyst. Several patents disclose the use of a reducing atmosphere to passivate cracking catalyst. U.S. Pat. Nos. 4,280,895 and 4,280,896 disclose that cracking catalyst can be passivated by passing the catalyst through a passivation zone having a reducing atmosphere maintained at an elevated temperature for a period of time ranging from 30 seconds to 30 minutes, typically from about 2 to 5 minutes. These patents disclose that process gas streams containing $H_2$ and/or CO can be utilized, such as cat cracker tail gas, catalytic reformer off-gas, spent hydrogen streams from catalytic hydroprocessing, synthesis gas and flue gases.

U.S. Pat. Nos. 4,298,459 and 4,280,898 describe processes for cracking a metals-containing feedstock where the used cracking catalyst is subjected to alternate exposures of up to 30 minutes of an oxidizing zone and a reducing zone maintained at an elevated temperature to reduce the hydrogen and coke makes.

U.S. Pat. No. 4,268,416 also describes a method for passivating cracking catalyst in which metal contaminated cracking catalyst is contacted with a reducing gas at elevated temperatures to passivate the catalyst.

U.S. Pat. Nos. 4,361,496; 4,364,848; and 4,382,015 describe metals passivation processes in which the metals contaminated catalyst is contacted with hydrogen and with a $C_1$–$C_3$ hydrocarbon at an elevated temperature to reduce the metal contaminants and to selectively coat the contaminant sites with a layer of carbon.

European Patent Publication No. 52,356 also discloses that metal contaminants can be passivated utilizing a reducing atmosphere at an elevated temperature. This publication discloses that the reducing gas source can include regenerator off gases or light gases from the catalytic cracker.

International Patent Application No. WO82/04063 discloses the contacting of a regenerated catalyst with a reducing gas at elevated temperature to reduce oxidized nickel deposits on the cracking catalyst.

U.S. Pat. Nos. 4,372,840 and 4,372,841 describe the use of hydrogen donors to further decrease the hydrogen and coke makes in a process employing a passivating zone having a reducing atmosphere maintained at an elevated temperature. The hydrogen donor compounds may be passed through a hydrogenation zone prior to their being added to the reaction zone.

U.S. Pat. Nos. 3,479,279 and 4,035,285 disclose hydrotreating of catalytic cracker product cuts and recirculating this product to the catalytic cracker. Related U.S. Pat. Nos. 3,413,212 and 3,533,936 disclose the use of hydrogen donor materials for decreasing the rate of coke formation on cracking catalyst. These patents each disclose in Table V that hydrotreating a fraction from a catalytic cracking zone and returning the hydrotreated material with the cat cracker feed decreases the coke make in the catalytic cracking zone. These patents also disclose that the hydrotreated material preferably is a hydrogen donor material which releases hydrogen to unsaturated olefinic hydrocarbons in a cracking zone without dehydrogenative action. Suitable materials disclosed are hydroaromatic, naphthene aromatic and naphthenic compounds. Preferred materials are compounds having at least one, and preferably two, three, or four, aromatic nuclei, partially hydrogenated and containing olefinic bonds. The hydrogen donor material was hydrogenated by contacting the donor material with hydrogen over a suitable hydrogenation catalyst at hydrogenation conditions.

It has been found that the presence of unsaturated compounds, particularly olefinic compounds, such as ethylene, in refinery gas streams contributes to excessive coke formation on the cracking catalyst. Excessive coke formation on the cracking catalyst is not desirable for several reasons. The presence of coke on cracking catalyst decreases the activity of the catalyst. Excess coke on the catalyst may also result in excess heat being liberated from the catalyst when the catalyst subsequently is regenerated. In some facilities where the regeneration zone capacity is limited by the air blower capacity, excess coke on the catalyst may require a reduction in the feed rate to the reaction zone.

Accordingly, it is desirable to provide a process which is capable of passivating metal contaminants on cracking catalyst utilizing available reducing gas sources without excess coke formation.

It also is desirable to provide a process for passivating cracking catalyst which is capable of utilizing reducing gas generated by the cracking zone.

It also is desirable to provide a process for hydrogenating unsaturated hydrocarbon compounds present in the reducing gas stream.

The subject invention is directed at a method for reducing the concentration of unsaturated hydrocarbons present in commercially available reducing gas streams prior to the introduction of these streams into a passivation zone to passivate metal contaminants deposited on cracking catalyst. In a preferred embodiment, the present invention hydrogenates the unsaturated compounds, such as olefins, present in the reducing gas prior to the addition of the reducing gas to the passivation zone. The reducing gas preferably is passed through a hydrogenation zone to hydrogenate the olefin before being added to the passivation zone.

SUMMARY OF THE INVENTION

The present invention is directed at a method for reducing the detrimental effects of metal contaminants on cracking catalyst where the feedstock contains a metal contaminant selected from the group consisting of nickel, vanadium, iron and mixtures thereof. The present invention is directed at a method comprising:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature by the addition to the passivation zone of process reducing gas containing an unsaturated hydrocarbon prior to the catalyst being returned to the reaction zone, the improvement wherein the unsaturated hydrocarbon content of the process reducing gas is decreased prior to the addition of the process reducing gas to the passivation zone.

In a preferred embodiment of the unsaturated hydrocarbon content of the process reducing gas is decreased by passing the process reducing gas through a hydrogenation zone before the process reducing gas is added to the passivation zone. In such an embodiment, where the method for reducing the detrimental effects of metal contaminants on the feedstock the feedstock comprises:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature prior to the catalyst being returned to the reaction zone, the improvement wherein the reducing conditions are maintained in the passivation zone by passing process reducing gas through a hydrogenation zone adapted to hydrogenate an unsaturated compound present in the reducing gas prior to the reducing gas entering the passivation zone.

The passivation zone preferably is disposed downstream of the regeneration zone, regenerated catalyst passing through the passivation zone prior to being returned to the reaction zone. The process reducing gas preferably comprises a petroleum refinery process reducing gas. The hydrogenation zone preferably comprises a supported or unsupported catalyst having a group VIII metal, such as nickel, platinum, palladium, cobalt or mixtures thereof. Depending upon the molecular hydrogen content of the process reducing gas, a separate molecular hydrogen containing stream optionally may be added to the hydrogenation zone.

BRIEF DESCRIPTION OF THE DRAWING

The FIGURE is a flow diagram of a fluidized cracking unit employing the subject invention.

DETAILED DESCRIPTION OF THE INVENTION

Referring to the FIGURE, one method for practicing the subject invention is shown. In this drawing pipes, valves, instrumentation, etc. not essential to an understanding of the invention have been deleted for simplicity. Reaction or cracking zone 10 is shown containing a fluidized catalyst bed 12 having a level at 14 in which a hydrocarbon feedstock is introduced into the fluidized bed through line 16 for catalytic cracking. The hydrocarbon feedstock may comprise naphthas, light gas oils, heavy gas oils, residual fractions, reduced crude oils, cycle oils derived from any of these, as well as suitable fractions derived from shale oil, kerogen, tar sands, bitumen processing, synthetic oils, coal hydrogenation, and the like. Such feedstocks may be employed singly, separately in parallel reaction zones, or in any desired combination. Typically, these feedstocks will contain metal contaminants such as nickel, vanadium and/or iron. Heavy feedstocks typically contain relatively high concentrations of vanadium and/or nickel. Hydrocarbon gas and vapors passing through fluidized bed 12 maintain the bed in a dense turbulent fluidized condition. Typically the temperature in reaction zone 10 will range between about 450° and about 600° C., while the pressure will range between about 0 and about 50 psig.

In reaction zone 10, the cracking catalyst becomes spent during contact with the hydrocarbon feedstock due to the deposition of coke thereon. Thus, the terms "spent" or "coke-contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 wt.% or more. Typically, spent catalyst coke contents vary from about 0.5 to about 1.5 wt.%.

Prior to actual regeneration, the spent catalyst is usually passed from reaction zone 10 into a stripping zone 18 and contacted therein with a stripping gas, which is introduced into the lower portion of zone 18 via line 20. The stripping gas, which is usually introduced at a pressure of from about 10 to 50 psig, serves to remove most of the volatile hydrocarbons from the spent catalyst. A preferred stripping gas is steam, although nitrogen, other inert gases or flue gas may be employed. Normally, the stripping zone is maintained at essentially the same temperature as the reaction zone, i.e., from about 450° C. to about 600° C. Stripped spent catalyst from which most of the volatile hydrocarbons have been removed, is then passed from the bottom of stripping zone 18 through a first transfer zone, such as U-bend 22 and connecting vertical riser 24 which extends into the lower portion of a regeneration zone. Air is added to riser 24 via line 28 in an amount sufficient to reduce the density of the catalyst flowing therein, thus causing the catalyst to flow upwardly into regeneration zone 26 by simple hydraulic balance.

In the particular configuration shown, the regeneration zone is a separate vessel (arranged at approximately the same level as reaction zone 10) containing a dense phase catalyst bed 30 having a level indicated at 32, which is undergoing regeneration to burn-off coke deposits formed in the reaction zone during the cracking reaction, above which is a dilute catalyst phase 34. An oxygen-containing regeneration gas enters the lower portion of regeneration zone 26 via line 36 and passes up through a grid 38 in the dense phase catalyst bed 30, maintaining said bed in a turbulent fluidized condition similar to that present in reaction zone 10. Oxygen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen.

Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec., preferably from about 1.5 to about 4 feet/sec. The temperature in regeneration zone 26 will vary with location within the zone and typically will range between about 600° and about 800° C.

In regeneration zone 26, flue gases formed during regeneration of the spent catalyst pass from the dense catalyst bed 30 into the dilute catalyst phase 34 along with entrained catalyst particles. The catalyst particles are separated from the flue gas by a suitable gas-solid separation means 54 and are returned to the dense phase catalyst bed 30 via diplegs 56. The substantially catalyst-free flue gas then passes into a plenum chamber 58 prior to discharge from regeneration zone 26 through line 60. Regeneration zone 26 may be operated in a net oxidizing mode, where sufficient oxygen is added to completely combust the coke on the catalyst to $CO_2$, or the regeneration zone may be operated in a net reducing mode, where insufficient oxygen is added to completely combust the coke. In the present case, where a passivation zone is employed, operation of regeneration zone 26 in the net reducing mode is preferred.

Regenerated catalyst exiting from regeneration zone 26 preferably has had a substantial portion of the coke removed. Typically, the carbon content of the regenerated catalyst will range from about 0.01 to about 0.2 wt.%, preferably from about 0.01 to about 0.1 wt.%. The regenerated catalyst from the dense phase catalyst bed 30 in regeneration zone 26 flows downwardly through standpipe 42, U-bend 44 and riser 80 into passivation zone or reduction zone 70 containing a catalyst bed 74 having a level 76.

Passivation zone 70 may be any vessel providing suitable contacting of the catalyst with a reducing environment at elevated temperatures. The shape of passivation zone 70 is not critical. In the embodiment shown, passivation zone 70 comprises a treater vessel having a shape generally similar to that of regeneration zone 26, with the reducing environment maintained, and catalyst fluidized by a reducing agent, such as a process reducing gas stream, entering through line 72 and exiting through line 78. The volume of dense phase 74 having a level at 76 is dependent on the required residence time. The residence time of the catalyst in passivation zone 70 is not critical as long as it is sufficient to effect the passivation. The residence time will range from about 30 sec. to about 30 min., typically from about 2 to 5 minutes. The pressure in this zone is not critical and generally will be a function of the location of passivation zone 70 in the system and the pressure in the adjacent regeneration and reaction zones. In the embodiment shown, the pressure in zone 70 will be maintained in the range of about 5 to 50 psia, although the reduction zone preferably should be designed to withstand pressures of 100 psia. The temperature in passivation zone 70 should be above about 500° C. preferably above 600° C., but below the temperature at which the catalyst sinters or degrades. A preferred temperature range is about 600°-850° C., with the more preferred temperature range being 650°-750° C.

Passivation zone 70 can be constructed of any chemically resistant material sufficiently able to withstand the relatively high temperatures involved and the high attrition conditions which are inherent in systems wherein fluidized catalyst is transported. Specially, metals are contemplated which may or may not be lined. More specifically, ceramic liners are contemplated within any and all portions of the reduction zone together with alloy use and structural designs in order to withstand the maximum contemplated operating temperatures.

A process reducing gas stream is shown entering hydrogenation zone 90 having hydrogenation catalyst therein through line 92. Depending upon the molecular hydrogen content of the process reducing gas stream hydrogen may or may not be added to hydrogenation zone 90. In the embodiment shown molecular hydrogen may be added to hydrogenation zone 90 through line 94. The reducing gas stream exiting hydrogenation zone 90 having a reduced unsaturate content passes through line 72 into passivation zone 70. The degree to which the unsaturates are saturated will be dependent on many factors, including the degree to which the entering process reducing gas stream is unsaturated, the residence time in hydrogenation zone 90, the particular hydrogenation catalyst utilized, the operating temperature and pressure in the hydrogen zone, and the hydrogen content of the process reducing gas stream. The degree to which the process gas stream is unsaturated will be dependent primarily on the gas source. In a typical petroleum refinery, preferred sources of the process gas stream are catalytic cracker tail gas streams, reformer tail gas streams, spent hydrogen streams from catalytic hydroprocessing, synthesis gas, steam cracker gas, flue gas, and mixtures thereof, where the unsaturates content typically will range between about 0.1 and about 50 wt.%. A particularly preferred source of the processing reducing gas is cat cracker tail gas.

Hydrogenation catalysts are well known in the art. The particular hydrogenation catalyst used is not critical. Typical hydrogenation catalysts which may be satisfactory include group VIII metals, such as nickel, platinum, palladium, cobalt and mixtures thereof on a catalyst support or an unsupported catalyst, such as a Raney nickel catalyst. A particularly preferred hydrogenation catalyst is nickel on alumina. The use of hydrogenation catalysts is described in Catalytic Hydrogenation over Platinum Metals by P. N. Rylander, New York Academic Press (1967), the disclosure of which is incorporated herein by reference. The temperature of hydrogenation zone 90 may range between about 25° C. and about 250° C., preferably between about 100° C. and about 200° C. The pressure in hydrogenation zone 90 may range between about 0 psig and about 300 psig, preferably between about 50 psig and about 100 psig. The process reducing gas residence time in hydrogenation zone 90 will be dependent, in part, on the desired degree of hydrogenation, the hydrogenation catalyst utilized, and the hydrogenation zone operating conditions. The residence time in hydrogenation zone 90 typically may range between about 5 seconds and about 30 minutes, preferably between about 1 and about 5 minutes.

The size of hydrogenation zone 90 will be dependent in part on the desired degree of saturation of the unsaturates, the unsaturates content in the process reducing gas, the catalyst utilized, the operating conditions in the hydrogenation zone, the process reducing gas consumption rate, and the total number of hydrogenation zones. While only one hydrogenation zone is shown, it is clear that a pluarlity of zones could be used.

In the initial series of tests described hereinafter to illustrate the advantages realized by saturating at least a portion of the unsaturates from a process reducing gas stream, a commercially available silica-alumina cracking catalyst, CBZ-1, manufactured by the Davison Chemical Division, W. R. Grace & Co. was contaminated with 0.48 wt.% nickel and 0.61 wt.% vanadium. In each test utilizing passivation zone 70, the catalyst was maintained in the indicated passivation zone reducing atmosphere at 750° C. for 20 minutes. The coke formed on the catalyst in passivation zone 70 by the process reducing gas was determined by catalyst sampling prior to the catalyst being used for catalytic cracking. A typical cat cracking feed comprising vacuum gas oil subsequently was passed over each of the catalyst samples maintained at 500° C. in a micro catalytic cracking (MCC) type unit.

Initial tests were conducted to determine base levels for hydrogen and coke makes, or yields, without passivation, and with passivation using research grade hydrogen and also using a typical cat cracker tail gas. The composition of these reducing streams is presented in Table I. The coke make attributable to the passivation treatment, and the hydrogen and coke makes attributable to the cracking process are presented in Table II.

EXAMPLE I

An olefin-free tail gas was prepared having the composition indicated in Table I. This olefin-free tail gas was used to passivate the cracking catalyst, afterwhich the catalyst was contacted with feed as before. The coke make attributable to the passivation treatment, and the hydrogen and coke makes resulting from contacting the feed are presented in Table II.

TABLE I

| Reducing Gas Utilized | Composition (wt. %) | | | | |
|---|---|---|---|---|---|
| | $H_2$ | $CH_4$ | $C_2H_4$ | $C_2H_6$ | $C_3H_8$ |
| Hydrogen | 100 | — | — | — | — |
| $C_2^-$ Cat Cracker Tail Gas | 50 | 25 | 12.5 | 12.5 | — |
| Olefin Free Tail Gas | 80 | 10 | — | 6 | 4 |

TABLE II

| Passivation Treatment | Wt. % Coke on Catalyst from Passivation | MCC Yields, wt. % | |
|---|---|---|---|
| | | $H_2$ | Coke |
| None | — | 1.23 | 11.69 |
| Hydrogen | — | 0.88 | 6.88 |
| $C_2^-$ Cat Cracker Tail Gas | 1.24 | 0.92 | 6.96* |
| Olefin-free Tail Gas | 0.04 | 0.91 | 7.64* |

*Coke attributable only to cracking process

A second series of tests was conducted utilizing the same catalyst. In this series of tests, the catalyst was again contaminated with 0.48 wt.% nickel and 0.61 wt.% vanadium. In each test utilizing a passivation zone, the catalyst was maintained in the particular reducing atmosphere at the indicated temperature for 20 minutes. Coke formed in the passivation zone by the particular reducing gas again was determined by catalyst sampling prior to the catalyst being used for cracking. The feed used for the cracking tests was the same as for the first series of tests. Initial tests again were conducted to determine base levels for hydrogen and coke makes without passivation and with passivation using research grade hydrogen and also using a typical $C_2^-$ cat cracker tail gas having the same composition as that shown in Table I. The coke makes attributable to each passivation treatment as well as the hydrogen and coke makes attributable to the cracking process are presented in Table III.

EXAMPLE II

An olefin-free reformer gas, comprising 75 wt.% $H_2$ and 25 wt.% $CH_4$ was used to passivate separate cracking catalyst samples at 650° C. and at 750° C. for 20 minutes. After passivation, the catalyst was utilized to crack the feedstock. The coke make attributable to the passivation treatment as well as the hydrogen and coke makes from the feed also are presented in Table III.

The data in Tables II and III illustrate that olefin-free reducing gas passivates metals contaminated cracking catalyst without producing as much coke as olefin-containing reducing gases. A comparison of Tables II and III also shows that, at 650° C. with passivation, the coke formation attributable to the olefins is not as significant as it is with passivation at 750° C. However, reduction zone passivation is more effective in reducing the hydrogen and coke makes at 750° C. than it is at 650° C.

TABLE III

| Passivation Treatment | Passivation Temperature | Wt. % Coke on Catalyst From Passivation | MCC Yields, Wt. % | |
|---|---|---|---|---|
| | | | $H_2$ | Coke |
| None | — | — | 1.23 | 11.69 |
| Hydrogen | 750° C. | — | 0.88 | 6.88 |
| $C_2^-$ Cat Cracker Tail Gas | | .24 | 0.92 | 6.96* |
| Reformer Gas | | 0.09 | 0.77 | 6.35* |
| Hydrogen | 650° C. | — | .12 | 8.81 |
| $C_2^-$ Cat Cracker Tail Gas | | 0.13 | .06 | 6.82* |
| Reformer Gas | | 0.11 | .00 | 6.04* |

*Coke attributable only to cracking process

Although the subject process has been described with reference to a specific embodiment, it will be understood that it is capable of further modification. Any variations, uses or adaptations of the invention following, in general, the principles of the invention are intended to be covered, including such departures from the present disclosure as come within known or customary practice in the art to which the invention pertains and as may be applied to the essential features hereinbefore set forth, and as fall within the scope of the invention.

What is claimed is:

1. In a cracking process, a method for reducing the adverse catalytic effects of metal contaminants selected from the group consisting of nickel, vanadium, iron and mixtures thereof, said method comprising:

A. contacting the feedstock containing the metal contaminant with a cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature by the addition to the passivation zone of process reducing gas containing an unsaturated hydrocarbon prior to the catalyst being returned to the reaction zone, the improvement wherein the unsaturated hydrocarbon content of the process reducing gas is decreased prior to the addition of the process reducing gas to the passivation zone.

2. The process of claim 1 wherein the unsaturated hydrocarbon content of the process reducing gas is decreased by passing process reducing gas through a hydrogenation zone prior to the introduction of the process reducing gas into the passivation zone.

3. The process of claim 2 further comprising the addition of a separate molecular hydrogen-containing stream to the hydrogenation zone.

4. In a cracking process, a method for reducing the adverse catalytic effects of metal contaminants selected from the group consisting of nickel, vanadium, iron and mixtures thereof, said method comprising:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature prior to the catalyst being returned to the reaction zone, the improvement wherein the reducing conditions are maintained in the passivation zone by passing process reducing gas having an unsaturated hydrocarbon therein through a hydrogenation zone adapted to hydrogenate the unsaturated hydrocarbon present in the reducing gas prior to the reducing gas entering the passivation zone.

5. The method of claim 4 wherein the unsaturated hydrocarbon comprises an olefin.

6. The method of claim 5 wherein the olefin comprises ethylene.

7. The method of claim 6 wherein the hydrogenation zone contains a hydrogenation catalyst comprising a group VIII metal.

8. The method of claim 7 wherein the hydrogenation catalyst comprises a metal selected from the group consisting of nickel, platinum, palladium and mixtures thereof.

9. The method of claim 8 wherein the hydrogenation zone temperature is maintained between about 25° C. and about 250° C.

10. The method of claim 9 wherein the pressure in the hydrogenation zone is maintained between about 0 psig and about 300 psig.

11. The method of claim 10 wherein the residence time of the process reducing gas in the hydrogenation zone ranges between about 5 seconds and about 30 minutes.

12. The method of claim 10 wherein the residence time of the reducing gas in the hydrogenation zone ranges between about 1 and 5 minutes.

13. The method of claim 11 wherein the process reducing gas comprises a petroleum refining process reducing gas.

14. The method of claim 13 wherein the petroleum refinery process reducing gas is selected from the group consisting of cat cracker tail gas, reformer tail gas, spent hydrogen from catalytic hydroprocessing, synthesis gas, steam cracker gas, flue gas, and mixtures thereof.

15. The method of claim 14 wherein the passivation zone is maintained at a temperature ranging between about 600° C. and about 850° C.

16. A cracking process for decreasing the molecular weight of a hydrocarbon feedstock containing metal contaminant, said method comprising:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst from the regeneration zone through a passivation zone maintained under reducing conditions at an elevated temperature prior to the catalyst being returned to the reaction zone;

D. passing process reducing gas having an unsaturated hydrocarbon therein through a hydrogenation zone adapted to saturate the unsaturated hydrocarbon compound present in the process reducing gas; and, E. passing the process reducing gas having a reduced unsaturated hydrocarbon content from the hydrogenation zone to the passivation zone.

17. The process of claim 16 wherein the unsaturated compound present in the process reducing gas comprises an olefin.

18. The process of claim 17 wherein the olefin comprises ethylene.

19. The process of claim 18 wherein the hydrogenation zone contains a hydrogenation catalyst comprising a group VIII metal.

20. The process of claim 19 wherein the hydrogenation catalyst comprises a metal selected from the group consisting of nickel, platinum, palladium and mixtures thereof.

21. The process of claim 20 wherein the catalyst comprises a supported catalyst.

22. The process of claim 20 wherein the hydrogenation zone is maintained at a temperature ranging between about 25° C. and about 250° C.

23. The process of claim 22 wherein the hydrogenation zone is maintained at a pressure ranging between about 0 psig and about 300 psig.

* * * * *